US007753505B2

(12) United States Patent
Sugahara et al.

(10) Patent No.: US 7,753,505 B2
(45) Date of Patent: Jul. 13, 2010

(54) INK CARTRIDGES AND INKJET PRINTERS

(75) Inventors: Hiroto Sugahara, Aichi-ken (JP); Shingo Hattori, Aichi-ken (JP)

(73) Assignee: Brother Kogyo Kabushiki Kaisha, Nahoya-shi, Aichi-ken (JP)

( * ) Notice: Subject to any disclaimer, the term of this patent is extended or adjusted under 35 U.S.C. 154(b) by 676 days.

(21) Appl. No.: 11/692,622

(22) Filed: Mar. 28, 2007

(65) Prior Publication Data

US 2007/0229619 A1 Oct. 4, 2007

(30) Foreign Application Priority Data

Mar. 30, 2006 (JP) ..... 2006-095468
Dec. 25, 2006 (JP) ..... 2006-347861

(51) Int. Cl.
*B41J 2/175* (2006.01)

(52) U.S. Cl. ..... 347/86

(58) Field of Classification Search ..... 347/49, 347/85, 86, 87
See application file for complete search history.

(56) References Cited

U.S. PATENT DOCUMENTS 5,583,549 A * 12/1996 Ujita et al. ..... 347/86
5,825,388 A * 10/1998 Sasaki ..... 347/86
5,886,721 A 3/1999 Fujii et al.
5,949,451 A * 9/1999 Takagi ..... 347/40
6,390,601 B1 * 5/2002 Morita et al. ..... 347/49
6,464,338 B1 * 10/2002 Morita et al. ..... 347/49
7,118,204 B2 * 10/2006 Hatasa et al. ..... 347/86
7,188,939 B1 3/2007 Sasaki
2003/0160847 A1 8/2003 Tsujimoto et al.

FOREIGN PATENT DOCUMENTS

EP 0581298 A2 2/1994
EP 1199179 A1 4/2002
EP 1219448 A2 7/2002
EP 1547786 A2 6/2005

OTHER PUBLICATIONS

European Patent Office, European Search Report for EP Appl'n No. 07006275 (counterpart to above-captioned patent appl'n) mailed Jul. 7, 2007.

* cited by examiner

*Primary Examiner*—Anh T. N. Vo
(74) *Attorney, Agent, or Firm*—Baker Botts L.L.P.

(57) ABSTRACT

An ink cartridge includes a wall, and an ink supply portion positioned at the wall. The ink supply portion has an ink supply opening formed therein. The ink cartridge also includes a plurality of protrusions which includes a first protrusion and a second protrusion, and each of the first protrusion and the second protrusion extend from the wall. In an embodiment, a distance between the first protrusion and the second protrusion is greater than 0 mm and less than a diameter of the ink supply opening. In another embodiment, the distance between the first protrusion and the second protrusion is greater than 0 mm and less than a diameter of the ink supply opening.

23 Claims, 12 Drawing Sheets

INK CARTRIDGES AND INKJET PRINTERS

The present application claims priority from Japanese Patent Application No. JP-2006-095468, which was filed on Mar. 30, 2006, and Japanese Patent Application No. JP-2006-347861, which was filed on Dec. 25, 2006, the disclosures of which are incorporated herein by reference in their entirety.

BACKGROUND OF THE INVENTION

1. Field of the Invention

The present invention relates generally to ink cartridges and inkjet printers which use such ink cartridges.

2. Description of Related Art

A known inkjet recording system includes an inkjet recording apparatus and a plurality of ink cartridges which are mounted side by side to a mounting portion of the inkjet recording apparatus. An ink supply opening is formed at one surface of the ink cartridge, and an ink supply needle is provided in the inkjet recording apparatus and is inserted through the ink supply opening when the ink cartridge is mounted to the inkjet recording apparatus, which causes ink within the ink cartridge to be supplied to inkjet recording apparatus. The ink cartridge includes a case and a bag positioned within the case. The bag has a port for supplying ink within the bag to the outside of the ink cartridge, and the port is aligned with the ink supply opening. A lid, a valve, and a spring are provided within the port, such that the spring urges the valve to contact the lid. Specifically, when the valve contacts the lid, fluid communication between the inside of the bag and the outside of the ink cartridge is prohibited, and when the ink supply needle pushes the valve against the urging force of the spring, the valve separates from the lid, the inside of the bag and the outside of the ink cartridge are in fluid communication with each other.

Ink adheres to the ink supply needle after the ink supply needle is inserted into the ink cartridge through the ink supply opening. The ink which adheres to the ink supply needle adheres adjacent to the ink supply opening when the ink cartridge is removed from the mounting portion. The ink may drip from the ink supply opening onto the mounting portion. When the ink drips from the ink supply opening onto the mounting portion, the mounting portion becomes dirtied. In addition, ink may drip from the ink supply needle onto the mounting portion. After the mounting portion becomes dirtied, when a new ink cartridge is mounted to the mounting portion, the new ink cartridge also becomes dirtied. When the new ink cartridge is removed from the mounting portion, a hand of user also may become dirtied. Moreover, when the ink supply needle is removed from the ink supply opening, the spring pushes the valve back toward the ink supply opening. Therefore, ink is pushed by the valve toward the ink supply opening, and a relatively large amount of ink may be pushed out of the ink supply opening.

Another known ink cartridge includes an ink supply portion protruding from one surface of the ink cartridge. An ink supply opening is formed at the end of the ink supply portion. Ink may also drip from the ink supply opening of this type of ink cartridge onto a mounting portion of an inkjet recording apparatus.

SUMMARY OF THE INVENTION

Therefore, a need has arisen for ink cartridges which overcome these and other shortcomings of the related art. A technical advantage of the present invention is that the ink cartridge may suppress ink from dripping from the ink cartridge. Another technical advantages of the present invention is that at least two protrusions may be positioned below the ink supply portion, and a distance between the at least two protrusions may be selected, such that the at least two protrusions retain ink, which drips from the ink supply portion, therebetween by a capillary force.

According to an embodiment of the present invention, an ink cartridge comprises a wall, and an ink supply portion positioned at the wall. For example, the ink supply portion may extend from the wall or may be substantially flush with the wall, and may be positioned adjacent to an end of the wall. The ink supply portion has an ink supply opening formed therein. The ink cartridge also comprises a plurality of protrusions which comprise a first protrusion and a second protrusion, and each of the first protrusion and the second protrusion extend from the wall. In an embodiment, a distance between the first protrusion and the second protrusion is greater than 0 mm and less than a diameter of the ink supply opening. In another embodiment, the distance between the first protrusion and the second protrusion is greater than 0 mm and less than a diameter of the ink supply opening.

According to another embodiment of the present invention, an ink cartridge comprises an ink chamber configured to store an ink, and a wall comprising a first end and a second end opposite the first end, and an ink supply portion which is positioned at the wall adjacent to the second end of the wall and protrudes from the wall. The ink supply portion has an end portion and an ink supply opening formed in the end portion, and the ink supply portion is configured to supply the ink from an interior of the ink chamber to an exterior of the ink cartridge through the ink supply opening. The ink cartridge also comprises a plurality of protrusions protruding from the wall, and each of the plurality of protrusions has an end portion. Moreover, a first distance between the end portion of each of the plurality of protrusions and the wall is greater than a second distance between the end portion of the ink supply portion and the wall, and the plurality of protrusions comprise a first protrusion and a second protrusion positioned adjacent to the first protrusion. In addition, the first protrusion is separated from the second protrusion by a separation distance which is greater than 0 mm and less than or equal to 5 mm.

According to another embodiment of the present invention, an ink cartridge comprises an ink chamber configured to store an ink, and a wall comprising a first end and a second end opposite the first end. The ink cartridge also comprises an ink supply portion which is positioned at the wall, e.g., adjacent to the second end of the wall, and protrudes from the wall or is substantially flush with the wall, and the ink supply portion has an end portion and an ink supply opening formed in the end portion. Moreover, the ink supply portion is configured to supply the ink from an interior of the ink chamber to an exterior of the ink cartridge through the ink supply opening. The ink cartridge further comprises a first protrusion protruding from the wall, and a second protrusion protruding from the wall, and each of the first protrusion and the second protrusion has an end portion, and a first distance between the end portion of each of the first protrusion and the second protrusion and the wall is greater than a second distance between the end portion of the ink supply portion and the wall. Moreover, a particular separation distance between the first protrusion and the second protrusion is greater than 0 mm and less than a diameter of the ink supply opening.

Other features and technical advantages of the present invention will be apparent to persons of ordinary skill in the art in view of the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

FIG. 3(*b*) is a partial, cross-sectional view of the ink cartridge and the inkjet printer of FIG. 1, after the mounting of the ink cartridge to the inkjet printer is completed.

FIG. 4(*b*) is a schematic diagram of the ink cartridge of FIG. 1 when ink is dripping.

FIG. 4(*c*) is a schematic diagram of the ink cartridge of FIG. 1 when ink is caught between two protrusions.

FIG. 9(*b*) is partial, cross-sectional view taken along IXA-IXA line in FIG. 8 when an ink droplet is dripping from an ink supply portion.

DETAILED DESCRIPTION OF EMBODIMENTS OF THE INVENTION

Embodiments of the present invention, and their features and advantages, are understood by referring to FIGS. 1-12, like numerals being used for like corresponding parts in the various drawings.

Figure 1:
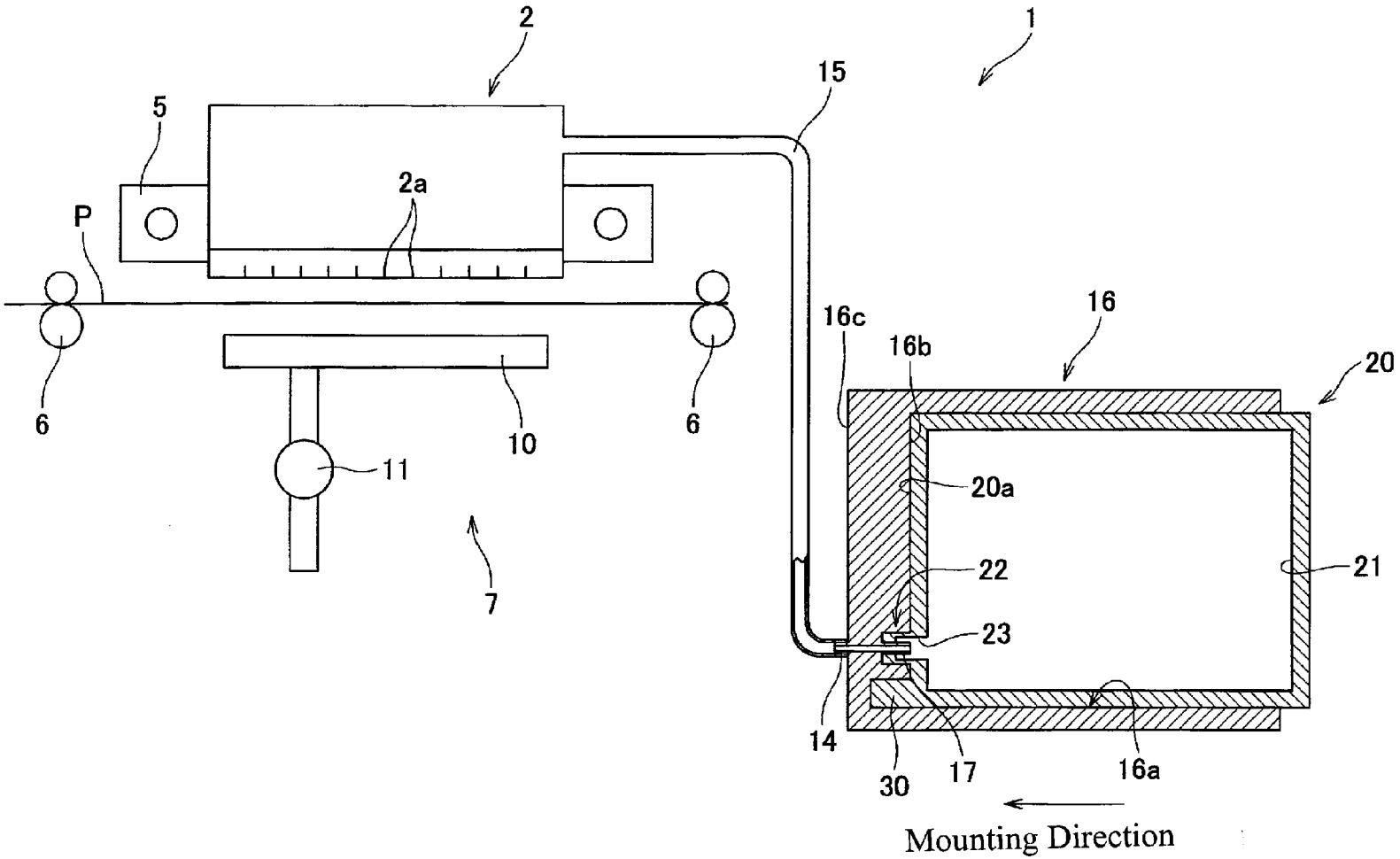
FIG. 1 is a schematic diagram of an inkjet printer and an ink cartridge, according to an embodiment of the present invention.

Referring to FIG. 1, an inkjet printer 1 may comprise an inkjet head 2, a mounting portion 16, a flexible tube 15, a carriage 5, a feeding mechanism 6, and a purge device 7. Inkjet head 2 also may comprise a plurality of nozzles 2*a* configured to eject ink toward a recording paper P, and mounting portion 16 may be configured to mount an ink cartridge 20. Inkjet head 2 and ink cartridge 20 may be in fluid communication with each other through tube 15 when ink cartridge 20 is mounted to mounting portion 16. Carriage 5 may be configured to reciprocate with inkjet head 2, feeding mechanism 6 may be configured to feed recording paper P, and purge device 7 may be configured to draw out air or thickened ink from the inside of inkjet head 2.

During a printing operation, inkjet head 2 reciprocates with carriage 5 in a direction which is perpendicular to a plane of FIG. 1, and recording paper P is fed by feeding mechanism 6 in a horizontal direction in FIG. 1. Inkjet head 2 faces recording paper P, and the reciprocation of inkjet head 2 and feeding of recording paper P may be synchronized by a control means. Each time inkjet head 2 crosses recording paper P, inkjet head 2 ejects ink from nozzles 2*a*, and ink is supplied from ink cartridge 20 through tube 15. Nozzles 2*a* are positioned higher than mounting portion 16 and ink cartridge 20 to prevent ink leakage from nozzles 2*a* when printing is not performed.

Purge device 7 may comprise a cap 10 and a pump 11. Cap 10 may be configured to selectively move toward and away from an ink-eject surface of inkjet head 2. Nozzles 2*a* may be positioned at the ink-eject surface, cap 10 may be configured to cover the ink-eject surface, and pump 11 may be configured to draw out ink from nozzles 2*a*. When inkjet head 2 is positioned out of a printable area, cap 10 may cover the ink-eject surface and pump 11 may draw out air or thickened ink from nozzles 2*a*. The printable area is defined as an area where inkjet head 2 may eject ink toward recording paper P. Evaporation of water from ink may result in thickening ink in nozzles 2*s*, and the purge operation may recover ink-eject performance of inkjet head 2.

Mounting portion 16 opens to the right in FIG. 1. Ink cartridge 20 may be inserted and mounted horizontally into an inside 16*a* of mounting portion 16 from the opening. An ink cartridge 20 may be removed from mounting portion 16 by pulling out a right edge of ink cartridge 20 to the right in FIG. 1.

Figure 2:
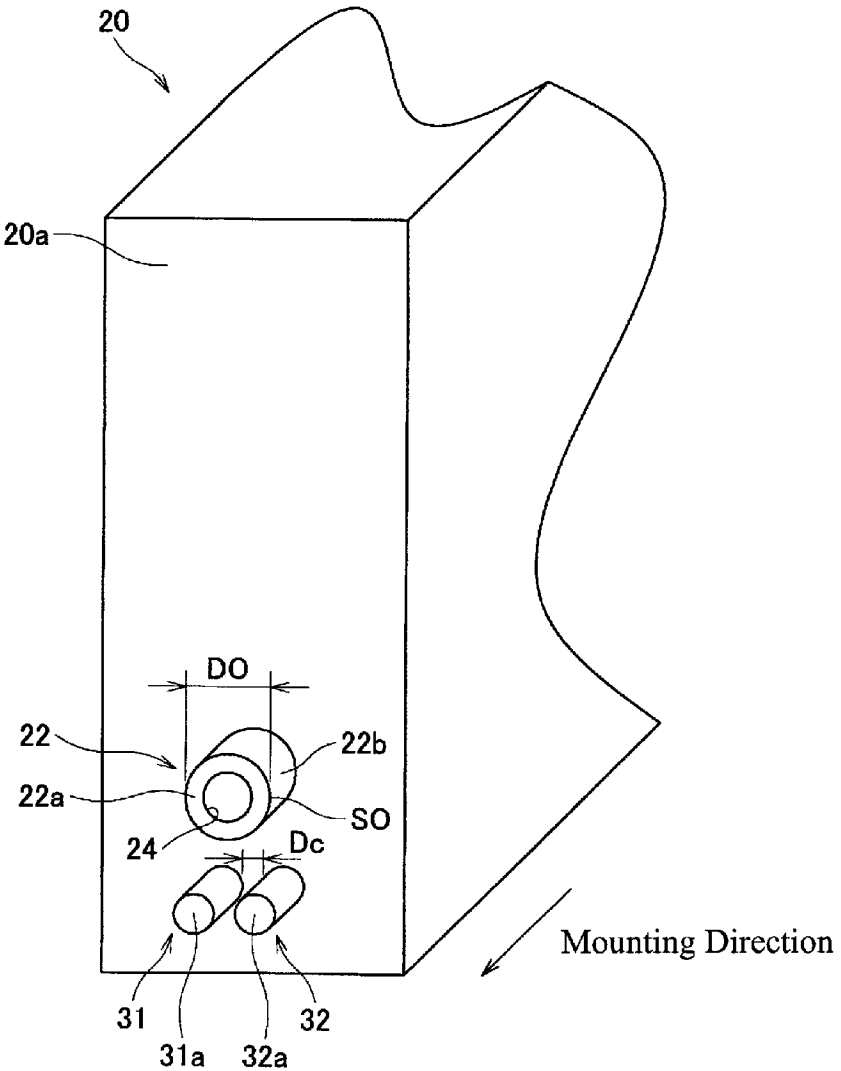
FIG. 2 is a partial, perspective view of the ink cartridge of FIG. 1.
Figure 3A:
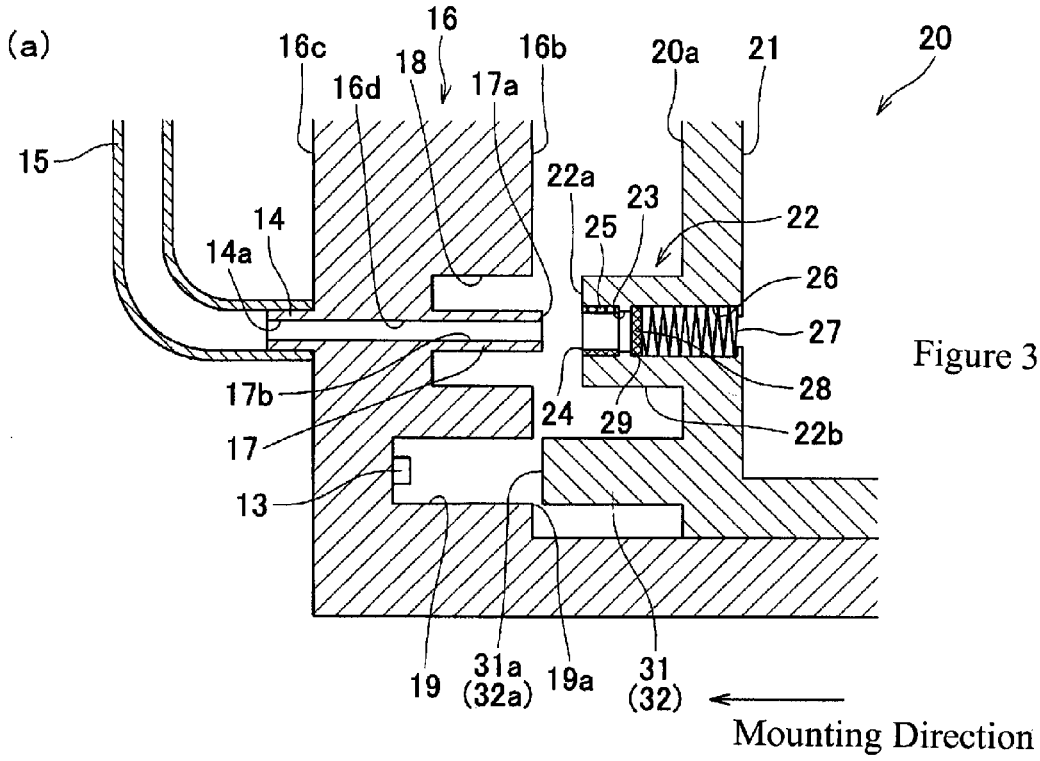
FIG. 3(*a*) is a partial, cross-sectional view of the ink cartridge and the inkjet printer of FIG. 1, just before mounting of the ink cartridge to the inkjet printer is completed.
Figure 3B:
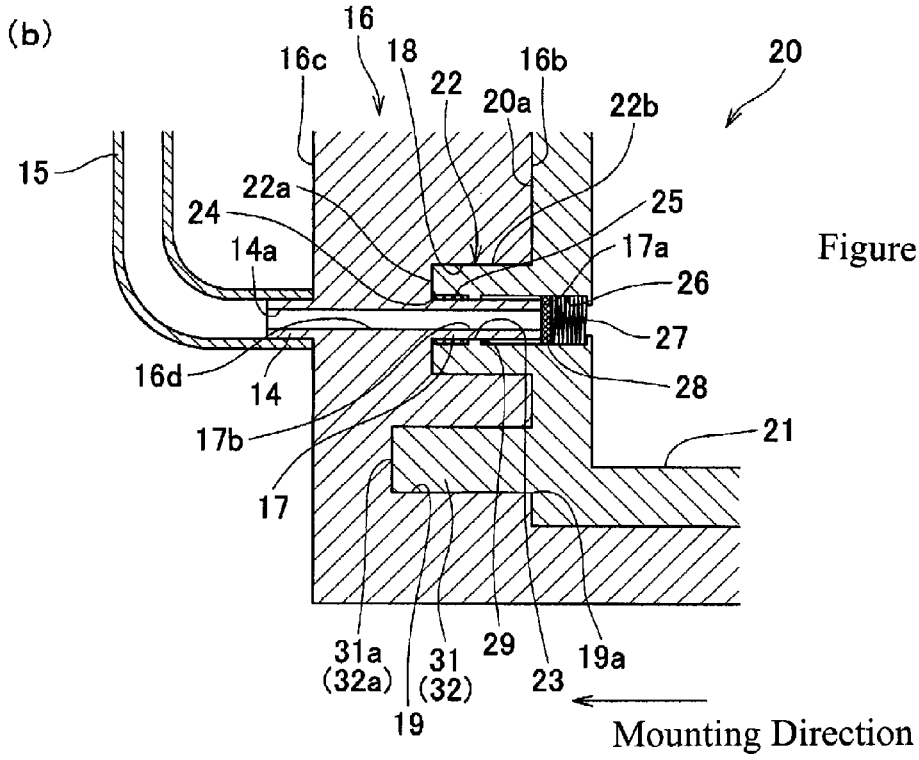

Referring to FIGS. 2, 3(*a*), and 3(*b*), ink cartridge 20 may have a rectangular, parallelepiped shape, and an ink chamber 21 may provided within ink cartridge 20. Ink cartridge 20 comprise a side wall 20*a* and a cylindrical ink supply portion 22 protruding from side wall 20*a*. Side wall 20*a* faces an end wall 16*b* of mounting portion 16, and ink supply portion 22 protrudes toward end wall 16*b* when ink cartridge 20 is mounted in mounting portion 16. The direction in which ink supply portion 22 protrudes may be substantially parallel with a direction in which ink cartridge 20 is mounted into mounting portion 16. Ink supply portion 22 may have an ink supply path 23 formed therethough. Ink supply path 23 may be in fluid communication with ink chamber 21 and an outside of ink cartridge 20. Ink may be supplied from ink chamber 21 to the outside of ink cartridge 20 though ink supply path 23. Ink supply path 23 may extend in a direction which is parallel with the direction in which ink cartridge 20 is mounted into mounting portion 16. Ink supply portion 22 may comprise an end surface 22*a*, which is most distant from side wall 20*a*. An ink supply opening 24 may be formed in a center of end surface 22*a*, and ink supply opening 24 may be round. Therefore, end surface 22*a* may be an annular surface encircling ink supply opening 24. Ink supply path 23 opens to the outside of ink cartridge 20 at ink supply opening 24. A direction in which ink is supplied from ink chamber 21 to the outside of ink cartridge 20 through ink supply path 23 may be parallel with the direction in which ink cartridge 20 is mounted into mounting portion 16, and perpendicular to end surface 22*a*. Accordingly, ink supply opening 24 may be formed in a plane which is perpendicular to the direction in which ink is supplied from ink chamber 21 to the outside of ink cartridge 20 through ink supply path 23.

A cylindrical-tube shaped seal 25 may be provided in ink supply path 23. Ink supply path 23 may have a center between ink chamber 21 and ink supply opening 24. Seal 25 may be positioned between ink supply opening 24 and a center of ink supply path 23. Seal 25 may comprise an elastic material, such as rubber. An ink supply tube 17 provided in mounting portion 16 may be inserted into seal 25 when ink cartridge 20 is mounted into mounting portion 16. Seal 25 may be elastically pressed against an outside surface of ink supply tube 17, preventing ink leakage from between the outside surface of ink supply tube 17 and seal 25. Ink supply path 23 may comprise a wider portion 26. Wider portion 26 may have a radius which is greater than a radius of ink supply opening 24. Wider portion 26 may extend from ink chamber 21 to about the center of ink supply path 23. A coil spring 27 and a valve 28 may be provided within wider portion 26. Coil spring 27 may be positioned between valve 28 and ink chamber 21, and may urge valve 28 toward the outside of ink cartridge 20 in the direction in which ink cartridge 20 is mounted into mounting portion 16. Wider portion 26 may be connected to the rest of ink supply path 23 at a connecting surface 29. Valve 28 may have a radius which is greater than a radius of the rest of ink supply path 23, but less than a radius of wider portion 26. Valve 28 may be urged against connecting surface 29 to prevent ink from leaking from ink chamber 21 to the outside of ink cartridge 20. When ink supply tube 17 pushes valve 28 against the force of coil spring 27 and valve 28 separates from connecting surface 29, ink flows into ink supply tube 17.

Ink cartridge 20 may comprise a first protrusion 31 and a second protrusion 32, and each of first protrusion 31 and second protrusion 32 may protrude from side wall 20*a* in the direction in which in cartridge 20 is mounted into mounting portion 16. Each of first protrusion 31 and second protrusion 32 may be cylindrical, and the direction in which protrusion 30 protrudes may be perpendicular to end surface 22*a*. Side wall 20*a* has a first end and a second end opposite to the first end. Ink supply portion 22 may be positioned adjacent to the second end of side wall 20*a*, and first protrusion 31 and second protrusion 32 may be positioned between ink supply portion 22 and the second end of side wall 20*a*. When ink cartridge 20 is mounted into mounting portion 16, first protrusion 31 and second protrusion 32 may be positioned below ink supply portion 22. Side wall 20*a* has a third end and fourth end opposite to the third end, and side wall 20*a* has a height between the first end of the side wall 20*a* and the second end of the side wall 20*a*. Side wall 20 also has a width between the third end of the side wall 20*a* and the fourth end of the side wall 20*a*. The direction of the height of side wall 20*a* is perpendicular to the direction of the width of side wall 20*a*, and the height of ink cartridge 20 corresponds to the height of side wall 20*a* and the width of the ink cartridge 20 corresponds to the width of side wall 20*a*. First protrusion 31 and second protrusion 32 may be aligned in the width direction and may be separated from each other. First protrusion 31 and second protrusion 32 also may have substantially the same shape, and the cross-sectional shape of each of first protrusion 31 and second protrusion 32 taken along a plane perpendicular to the direction in which ink cartridge 20 is mounted into mounting portion 16 may be substantially the same at any position of first protrusion 31 and second protrusion 32. Each of first protrusion 31 and second protrusion 32 may protrude from side wall 20*a* further than ink supply portion 22 protrudes from side wall 20*a*. First protrusion 31 may comprise an end surface 31*a*, which is most distant from side wall 20*a*, and second protrusion 32 may comprise an end surface 32*a*, which is most distant from side wall 20*a*. A distance between end surface 31*a* and side wall 20*a* may be greater than a distance between end surface 22*a* and side wall 20*a*, and a distance between end surface 32*a* and side wall 20*a* may be greater than a distance between end surface 22*a* and side wall 20*a*. A first line segment connecting a center of end surface 31*a* and a center of end surface 32*a* may be perpendicular to a second line segment connecting a center of the first line segment and a center of end surface 22*a*. The first line segment may be equal to a line segment connecting an axial center of first protrusion 31 and an axial center of second protrusion 32, and the second line segment may be equal to a line segment connecting the center of the first line segment and a center of ink supply opening 24. When viewed from the height direction, each of first protrusion 31 and second protrusion 32 may overlap an outer circumferential portion 22*b* of ink supply portion 20, and the center of end surface 22*a* may be positioned between first protrusion 31 and second protrusion 32. When ink cartridge 20 is mounted into mounting portion 16, each of first protrusion 31 and second protrusion 32 may overlap outer circumferential portion 22*b* of ink supply portion 20 in a plane view, and the center of end surface 22*a* may be positioned between first protrusion 31 and second protrusion 32 in a plane view.

Referring to FIGS. 3(*a*) and 3(*b*), ink supply tube 17 may be provided in mounting portion 16. Ink supply tube 17 may be inserted into ink supply path 23 through ink supply opening 24 when ink cartridge 20 is mounted into mounting portion 16. End surface 17*a* of ink supply tube 17 may be positioned closer to the opening of mounting portion 16 than end wall 16*b* is positioned to the opening of mounting portion 16. A cylindrical joint portion 14 may be positioned at an outside surface 16*c* of end wall 16*b*, and one end of tube 15 may be connected to joint portion 14. A communication hole 16*d* may be formed through end wall 16*b*, a communication hole 17*b* may be formed through ink supply tube 17, and a communication hole 14*a* formed through joint portion 14 may be in fluid communication through communication hole 16*d*. Ink may be supplied from ink chamber 21 to inkjet head 2 through communication hole 17*b*, communication hole 16*d*, communication hole 14*a*, and tube 15.

A round recess 18 may be formed in end wall 16*b*, and ink supply tube 17 may protrude from the bottom of round recess 18. Round recess 18 may be configured to receive ink supply portion 22 when ink cartridge 20 is mounted into mounting portion 16. The depth of round recess 18 may be greater than or equal to the protruding distance of ink supply portion 22 from side wall 20*a*. Moreover, a portion of end surface 17*a* may be cut out.

Two recesses 19 may be formed in end wall 16*b*, and recesses 19 may be configured to receive first protrusion 31 and second protrusion 32, respectively, when ink cartridge 20 is mounted into mounting portion 16. Because FIGS. 3(*a*) and 3(*b*) are cross-sectional views, only one of recesses 19 is shown. Nevertheless, two recesses 19 may be formed in end wall 16*b* in areas corresponding to first protrusion 31 and second protrusion 32, respectively. Cross-sectional shapes of recesses 19 taken along a plane perpendicular to the direction in which ink cartridge 20 is mounted into mounting portion 16 may be substantially the same at any positions of recesses 19. The cross-sectional shape of recesses 19 may be similar to the cross-sectional shape of first protrusion 31 and second protrusion 32, and may have a size which is greater than or equal to the size of the cross-sectional shape of first protrusion 31 and second protrusion 32. Recesses 19 receiving first protrusion 31 and second protrusion 32 may position ink cartridge 20 accurately in mounting portion 16. Moreover, a plurality of ink cartridges 20 may be used. For example, four of ink cartridges 20 may be used, which may contain different-color inks such as cyan, magenta, yellow and black inks, respectively, and four of mounting portions 16 may be used, which receive the four ink cartridges 20, respectively. Protrusions 30 of the four ink cartridges may have different cross-sectional shapes, respectively, and recesses 19 configured to receive protrusions 30, respectively, may have different cross-sectional shapes corresponding to the cross-sectional shapes of protrusions 30, respectively. This may prevent an insertion of ink cartridge 20 into an incorrect one of mounting portions 16. For example, an insertion of ink cartridge 20 containing yellow ink into mounting portion 16 configured to receive ink cartridge 20 containing black ink may be prevented.

A switch 13 may be provided at the bottom of each of recesses 19, and switch 13 may comprise a moveable member and a spring. The moveable member may be urged by the spring to protrude from the bottom of recess 19. When the ink cartridge 20 is inserted into mounting portion 16, each of end surface 31*a* and end surface 32*a* pushes the moveable member against the urging force of the spring. When moveable member is pushed, a signal is transmitted to a control means. The control means determines the completion of mounting of ink cartridge 20 based on the signal. Therefore, a printing operation with ink cartridge 20 not mounted completely may be prevented. If the printing operation occurs when ink cartridge 20 is not mounted completely, air may be drawn into the inside of inkjet head, resulting in misprinting. First protrusion 31 and second protrusion 32 function not only as a means for retaining ink, but also as a means for determining the completion of the mounting of ink cartridge 20. This dual function may reduce the number of parts of ink cartridge 20. Moreover, in an embodiment, a single switch 13 may be provided at the bottom of either one of recesses 19.

When ink cartridge 20 is mounted from the state shown in FIG. 3(*a*) to the state shown in FIG. 3(*b*), end surface 17*a* of ink supply tube 17 pushes valve 28 against the urging force of coil spring 27. Because the outside surface of ink supply tube 17 is in contact with seal 25 during the mounting operation, ink in ink chamber 21 and wider portion 26 does not leak to the outside through seal 25, but instead flows into communication hole 17*b* through the cut-out formed in end surface 17*a*. Accordingly, when ink cartridge 20 is mounted to mounting portion 16, ink rarely leaks.

Figure 4A:
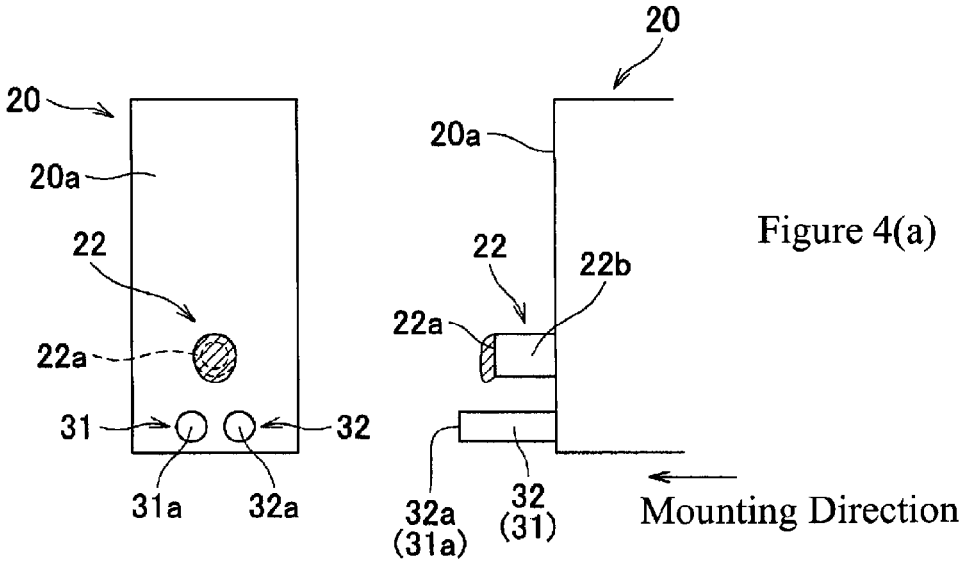
FIG. 4(*a*) is a schematic diagram of the ink cartridge of FIG. 1 when ink adheres to an ink supply portion.
Figure 4B:
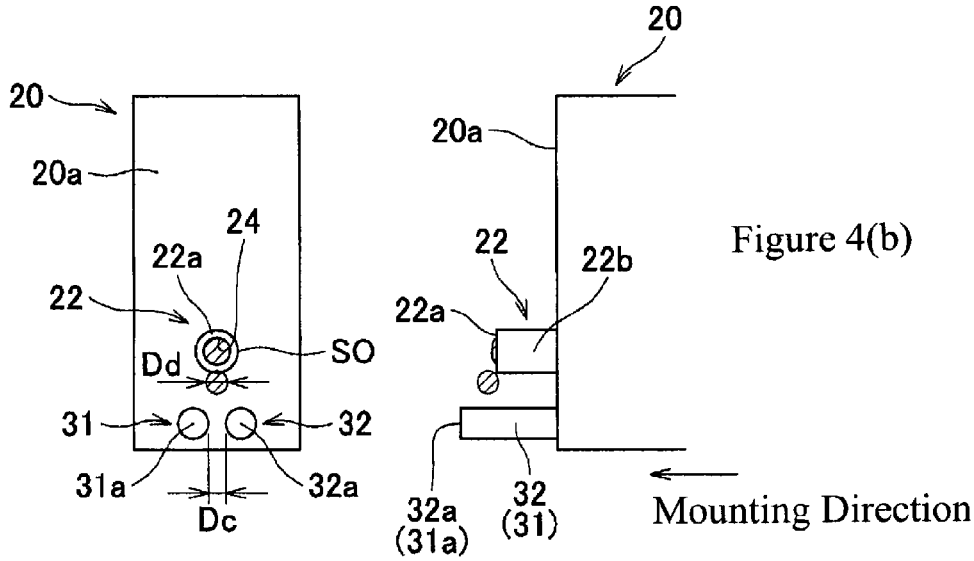
Figure 4C:
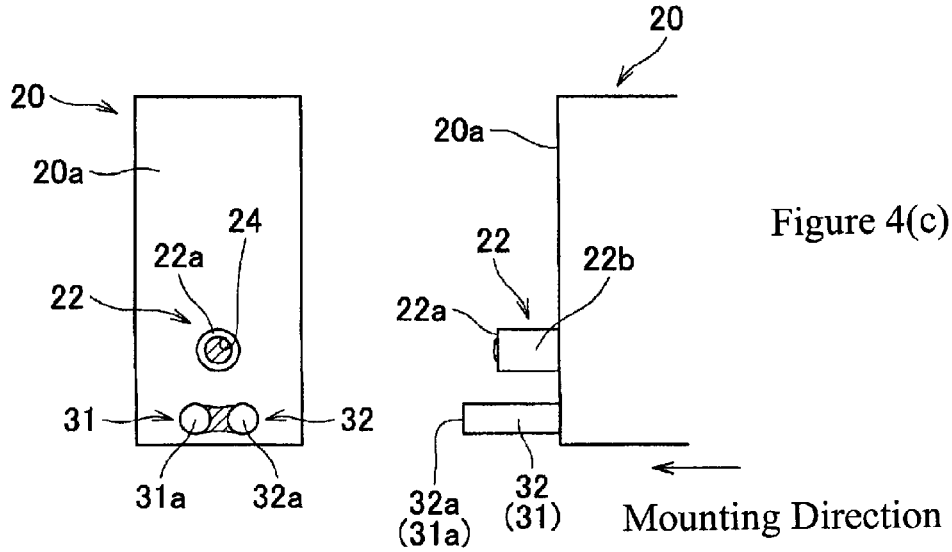

Nevertheless, when ink cartridge 20 is removed from mounting portion 16, ink may leak. When ink supply tube 17 is removed from ink supply path 23, valve 28 is pushed back to contact connecting surface 29. Valve 28 being pushed back may push ink from wider portion 26 toward ink supply opening 24, and this ink may drip from ink supply opening 24. In addition, when ink supply tube 17 is removed from ink supply path 23, ink adhering to outside surface of ink supply tube 17 may adhere to an area adjacent to ink supply opening 24, and this ink may drip from ink supply opening 24. In FIGS. 4(*a*)-4(*c*), ink and an ink droplet are shown with hatched lines. Referring to FIG. 4(*a*), ink adhering to end surface 22*a* may be retained on end surface 22*a* by surface tension. Nevertheless, referring to FIG. 4(*b*), when the amount of ink is too large, ink drips off as an ink droplet. In addition, ink adhering to the outside surface of ink supply tube 17 may drip off when ink supply tube 17 is removed from ink supply opening 24.

Surface tension is exerted on ink which has spread to an outer circumferential edge of end surface 22*a* and is retained on end surface 22*a*. When the weight of an ink droplet, which is about to drip from the ink on end surface 22*a*, becomes equal to the surface tension, the ink droplet separates from the ink on end surface 22*a* and falls, for example, in a spherical form. A relationship between a total force obtained by summing the surface tension exerted on the ink on end surface 22*a*, an outer circumferential length of end surface 22*a* and the surface tension of the ink, is represented by the following equation:

$$F0=S0\times\gamma$$

where

F0=the total force obtained by summing the surface tension exerted on the ink on end surface S0=the outer circumferential length of end surface 22*a*

γ=the surface tension of the ink.

For example, an outer diameter D0 of end surface 22*a* may be 5 mm, such that the outer circumferential length S0 is about 15.7 mm, and the surface tension of the ink is 35 mN/m. Therefore, the total force F0 obtained by summing the surface tension is about 55 mg-weight (about $5.5\times10^{-4}$ N). When the weight of the ink droplet, which is about to drip from the ink on end surface 22*a*, becomes equal to the total force F0 obtained by summing the surface tension, the ink droplet separates from the ink on end surface 22*a* and falls. A diameter Dd of the spherical ink droplet is calculated according to the following equation:

$$Dd=2((F0\times3)/(\rho\times\pi\times4))^{1/3}$$

where

ρ=density of the ink.

For example, the density ρ is 1.05 g/cm$^3$. When the total force F0 obtained by summing the surface tension is about 55 mg-weight and the density ρ is 1.05 g/cm$^3$, the diameter Dd of the ink droplet is about 4.6 mm. The ink droplet with this diameter Dd drips from end surface 22*a*, as shown in FIG. 4(*b*). Values of the outer circumferential length S0, the surface tension γ, and the density ρ are not limited to the above-described values. For example, the outer circumferential length S0 may be between about 15 mm and about 33 mm, the surface tension γ may be between about 30 mN/m and about 50 mN/m, and the density ρ may be between about 1 g/cm$^3$ and about 1.2 g/cm$^3$.

A separation distance Dc, which is a minimum distance between an outer circumference portion of first protrusion 31 and an outer circumference portion of second protrusion 32, is less than or equal to the diameter Dd of the ink droplet if the ink droplet is in a spherical form. That is, the following relationship is satisfied:

$$Dc\leqq2((F0\times3)/(\rho\times\pi\times4))^{1/3}$$

For example, the separation distance Dc may be about 4.5 mm. In addition, the separation distance Dc is less than a maximum diameter of ink supply opening 24. If separation distance Dc is less than or equal to 5 mm, a capillary force is generated between first protrusion 31 and second protrusion 32.

Referring to FIG. 4(*c*), the ink droplet falls to a center between first protrusion 31 and second protrusion 32. Because the separation distance Dc is less than or equal to the diameter Dd of the ink droplet, the ink droplet contacts the outer circumference portion of first protrusion 31 and the outer circumference portion of second protrusion 32, and first protrusion 31 and second protrusion 32 retains ink between them by capillary force.

The ink droplet may not have a spherical form. Nevertheless, because the separation distance Dc is less than a maximum diameter of ink supply opening 24, the ink droplet may be received by first protrusion 31 and second protrusion 32 and may be retained between first protrusion 31 and second protrusion 32 when the ink droplet is in any form.

As discussed above, when ink cartridge 20 is taken out of mounting portion 16, first protrusion 31 and second protrusion 32 may receive ink, which has dripped from ink supply opening 24/end surface 22*a*, and ink may be retained between first protrusion 31 and second protrusion 32 by capillary force. Accordingly, it may be prevented that mounting portion 16 gets dirtied by ink. Moreover, when ink cartridge 20 is in a posture such that first protrusion 31 and second protrusion 32 are positioned below ink supply portion 22 after ink cartridge 20 is taken out of mounting portion 16, first protrusion 31 and second protrusion 32 may catch and retain ink, which has dripped from ink supply opening 24/end surface 22*a*. Accordingly it may be prevented that peripheral areas of inkjet printer 1 gets dirtied by ink.

Because first protrusion 31 and second protrusion 32 protrude from side wall 20*a* from which ink supply portion 22 also protrudes, first protrusion 31 and second protrusion 32 may securely receive ink, and the structure of ink cartridge 20 may be simplified. Because first protrusion 31 and second protrusion 32 are positioned below ink supply portion 22, first protrusion 31 and second protrusion 32 may securely receive ink.

Moreover, because the following relationship is satisfied:

$$Dc \leqq 2((S0 \times \gamma \times 3)/(\rho \times \pi \times 4))^{1/3}$$

first protrusion 31 and second protrusion 32 may securely receive ink, assuming that the ink droplet is in a spherical form. Because the first line segment connecting an axial center of first protrusion 31 and an axial center of second protrusion 32 is perpendicular to the second line segment connecting a center of the first line segment and a center of ink supply opening 24, the ink droplet may contact the outer circumference portion of first protrusion 31 and the outer circumference portion of second protrusion 32, and first protrusion 31 and second protrusion 32 may securely retain ink between them.

Figure 5:
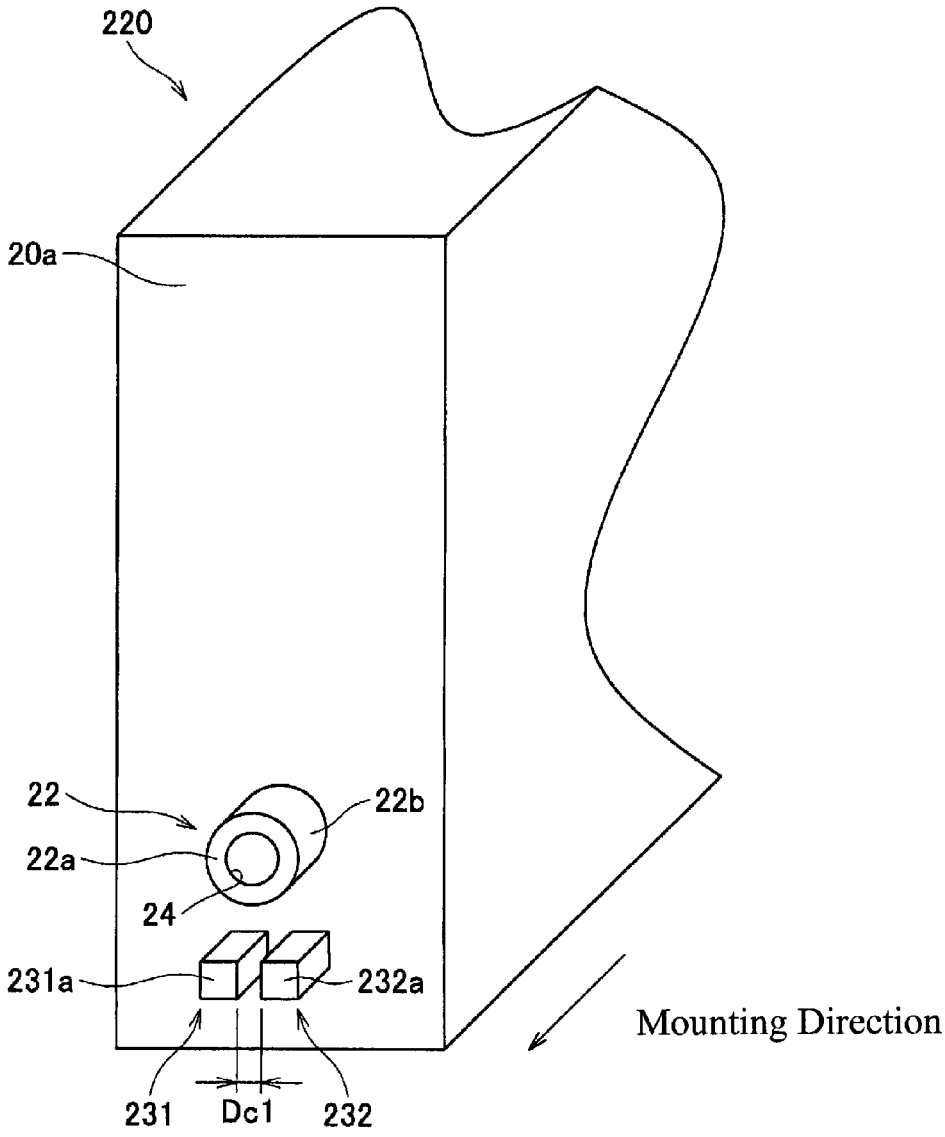
FIG. 5 is a partial, perspective view of an ink cartridge, according to another embodiment of the present invention.

Referring to FIG. 5, an ink cartridge 220, according to another embodiment of the present invention, may comprise a rectangular-column shaped first protrusion 231 and a second protrusion 232 protruding from side wall 20*a*, instead of cylindrical first protrusion 31 and second protrusion 32. First protrusion 231 and second protrusion 232 may be aligned in the width direction and may be separated from each other. First protrusion 231 may have an inner side surface facing toward second protrusion 232, and second protrusion 232 may have an inner side surface facing toward first protrusion 231. The inner side surface of first protrusion 231 and the inner side surface of second protrusion 232 may be parallel. A separation distance Dc1, which is a distance between the inner side surface of first protrusion 231 and the inner side surface of second protrusion 232, may be about 4.5 mm. The separation distance Dc1 may be less than a maximum diameter of ink supply opening 24. First protrusion 231 and second protrusion 232 may be positioned between ink supply portion 22 and the second end of side wall 20*a*. Each of first protrusion 231 and second protrusion 232 may protrude from side wall 20*a* further than ink supply portion 22 protrudes from side wall 20*a*. First protrusion 231 may have an end surface 231*a*, which is most distant from side wall 20*a*, and second protrusion 232 may have an end surface 232*a*, which is most distant from side wall 20*a*. A distance between end surface 231*a* and side wall 20*a* may be greater than a distance between end surface 22*a* and side wall 20*a*, and a distance between end surface 232*a* and side wall 20*a* may be greater than a distance between end surface 22*a* and side wall 20*a*. A first line segment connecting a center of end surface 231*a* and a center of end surface 232*a* may be perpendicular to a second line segment connecting a center of the first line segment and a center of end surface 22*a*. The first line segment may be equal to a line segment connecting an axial center of first protrusion 231 and an axial center of second protrusion 232. The second line segment may be equal to a line segment connecting the center of the first line segment and a center of ink supply opening 24. When viewed from the height direction, each of first protrusion 231 and second protrusion 232 may overlap an outer circumferential portion 22*b* of ink supply portion 20, and the center of end surface 22*a* may be positioned between first protrusion 231 and second protrusion 232. When ink cartridge 20 is mounted into mounting portion 16, each of first protrusion 231 and second protrusion 232 may overlap outer circumferential portion 22*b* of ink supply portion 20 in a plane view, and the center of end surface 22*a* may be positioned between first protrusion 231 and second protrusion 232 in a plane view. First protrusion 231 and second protrusion 232 may receive an ink droplet, which has dripped from ink supply opening 24/end surface 22*a*, and ink may be retained between first protrusion 231 and second protrusion 232 by a capillary force.

Figure 6:
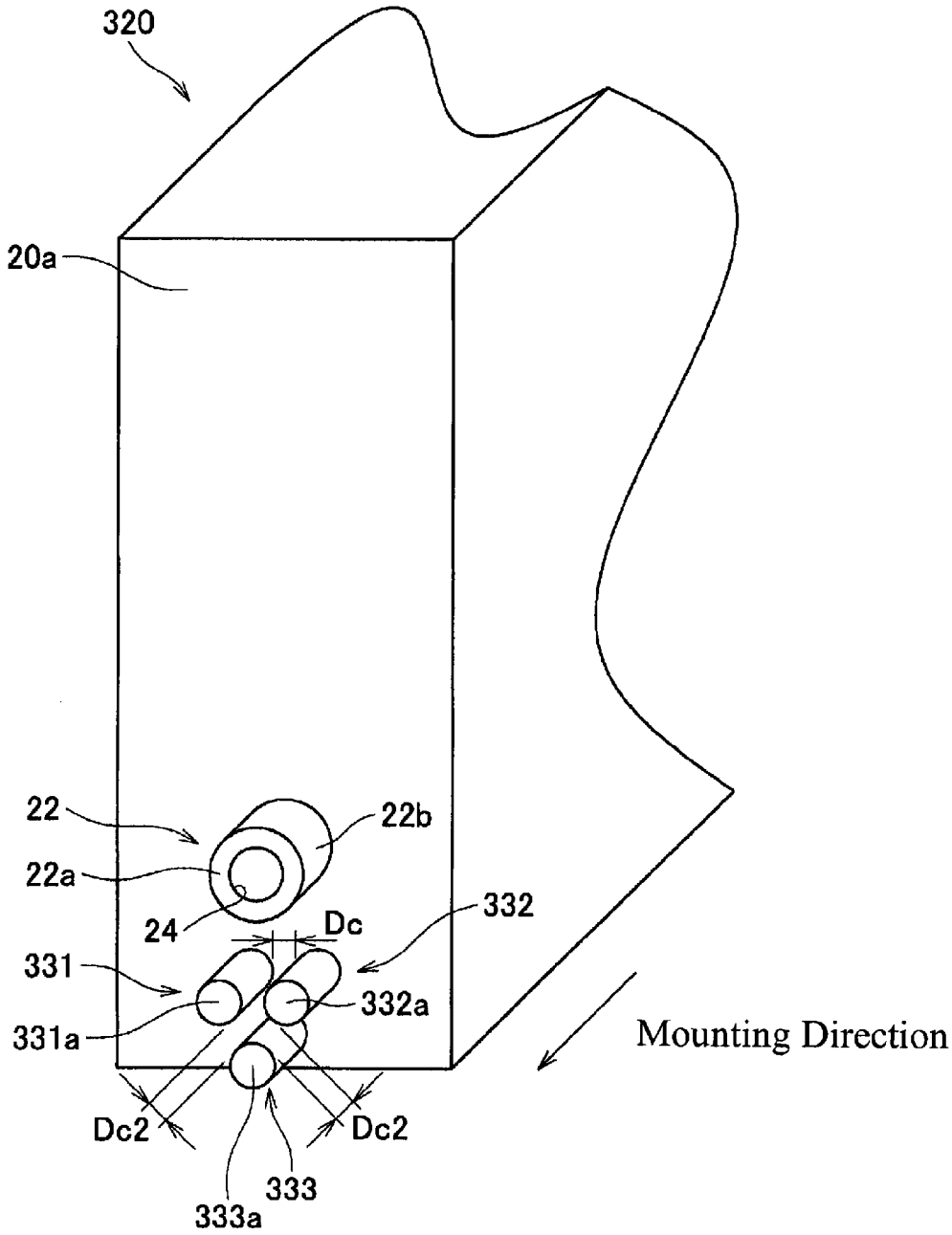
FIG. 6 is a partial, perspective view of an ink cartridge, according to yet another embodiment of the present invention.

Referring to FIG. 6, an ink cartridge 320, according to yet another embodiment of the present invention, may comprise a cylindrical first protrusion 331 and a second protrusion 332, which may be the same as first protrusion 31 and second protrusion 32, and a cylindrical third protrusion 333. Third protrusion 333 may be the same as first protrusion 331 and second protrusion 332 in shape and size. First protrusion 331, second protrusion 332, and third protrusion 333 may be positioned between the second end of the side wall 20*a* and ink supply portion 22. First protrusion 331 and second protrusion 332 may be positioned between third protrusion 333 and ink supply portion 22. First protrusion 331 may have an end surface 331*a*, which is most distant from side wall 20*a*, and second protrusion 332 may have an end surface 332*a*, which is most distant from side wall 20*a*. Third protrusion 333 may have an end surface 333*a*, which is most distant from side wall 20*a*. A first line segment connecting a center of end surface 331*a* and a center of end surface 332*a* may be perpendicular to a second line segment connecting a center of the first line segment and a center of end surface 333*a*. The first line segment may be equal to a line segment connecting an axial center of first protrusion 331 and an axial center of second protrusion 332. The second line segment may be equal to a line segment connecting the center of the first line segment and an axial center of third protrusion 333. A separation distance Dc2, which is a minimum distance between an outer circumference portion of first protrusion 331 and an outer circumference portion of third protrusion 333 and also is a minimum distance between an outer circumference portion of second protrusion 332 and an outer circumference portion of third protrusion 333, may be about 4.5 mm. The separation distance Dc2 may be less than a maximum diameter of ink supply opening 24. Separation distances Dc and Dc2 may be the same between first protrusion 331, second protrusion 332, and third protrusion 333. First protrusion 331, second protrusion 332, and third protrusion 333 may receive an ink droplet, which has dripped from ink supply opening 24/end surface 22*a*, and ink may be retained between first protrusion 331, second protrusion 332 and third protrusion 333 by a capillary force. Because of third protrusion 333, a greater amount of ink may be retained compared to above-described embodiments.

Figure 7:
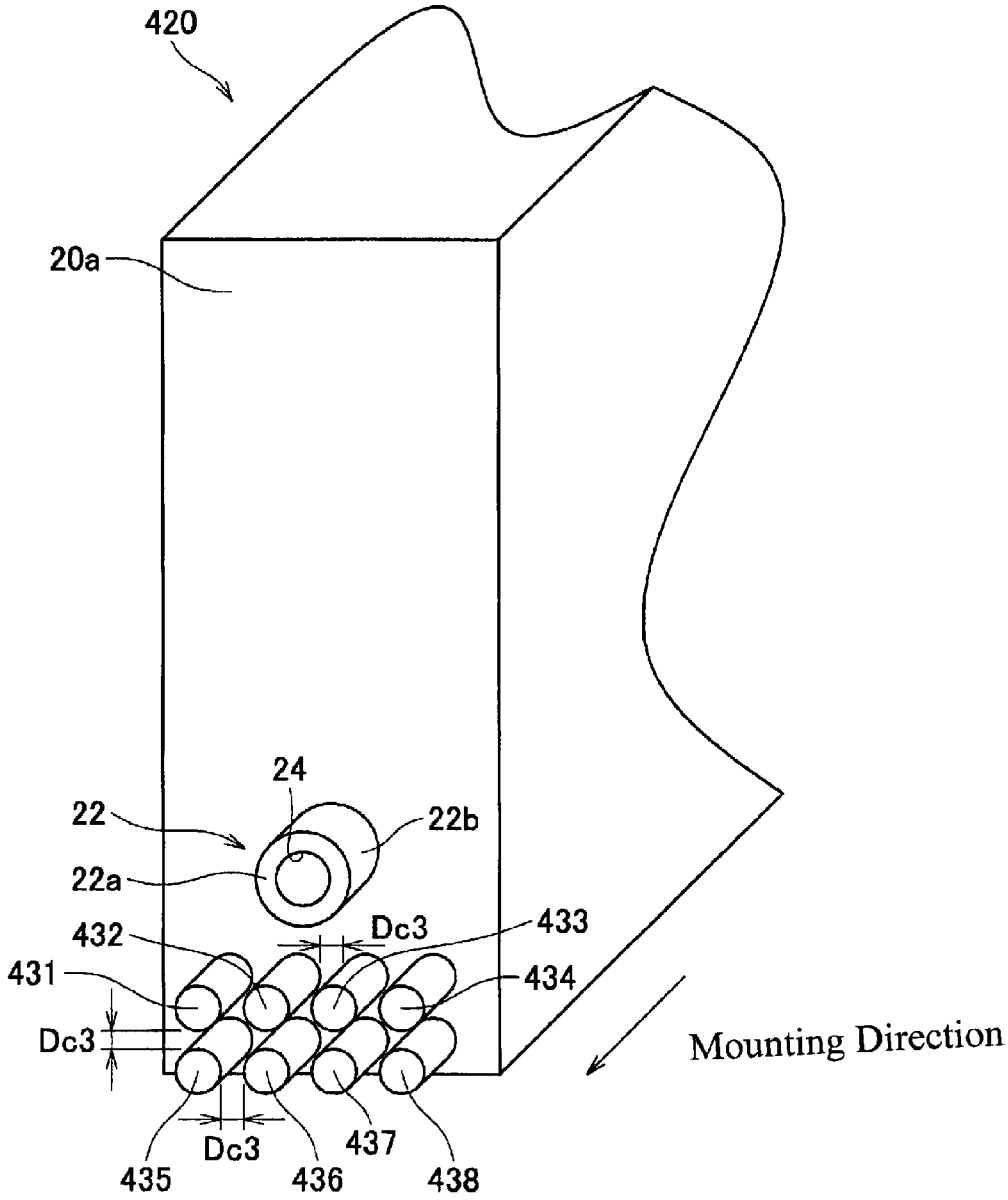
FIG. 7 is a partial, perspective view of an ink cartridge, according to still another embodiment of the present invention.

Referring to FIG. 7, an ink cartridge 420, according to still another embodiment of the present invention, may comprise eight protrusions 431-438 protruding from side wall 20*a*.

Eight protrusions 431-438 may be the same as first protrusion 31 and second protrusion 32 in shape and size. Four protrusions 431-434 are aligned in the width direction and four protrusions 435-438 are aligned in the width direction. Eight protrusions 431-438 may be positioned between the second end of the side wall 20*a* and ink supply portion 22. Four protrusions 431-434 may be positioned between four protrusions 435-438 and ink supply portion 22. A separation distance Dc3, which is a minimum distance between outer circumference portions of immediate neighboring protrusions in the width direction and in the height direction, may be about 4.5 mm. The separation distance Dc3 may be less than a maximum diameter of ink supply opening 24. A positional relationship between protrusion 432 and protrusion 433 and ink supply portion 22 may be the same as in between first protrusion 31 and second protrusion 32 and ink supply portion 22. Eight protrusions 431-438 may receive ink, which has dripped from ink supply opening 24/end surface 22*a*, and ink may be retained between immediate neighboring eight protrusions 431-438 by capillary force. Because the number of protrusions is greater, greater amount of ink may be retained compared to above-described embodiments. Moreover, when viewed from the height direction, some protrusions may overlap an outer circumferential portion 22*b* of ink supply portion 20, but the other protrusions may be positioned on both sides of ink supply portion 22. Therefore, even when the ink cartridge 420 is tilted after ink cartridge 420 is removed from mounting portion 16, eight protrusions 431-438 may receive ink, which has dripped from ink supply opening 24/end surface 22*a*, and ink may be retained between immediate neighboring eight protrusions 431-438 by a capillary force.

Figure 8:
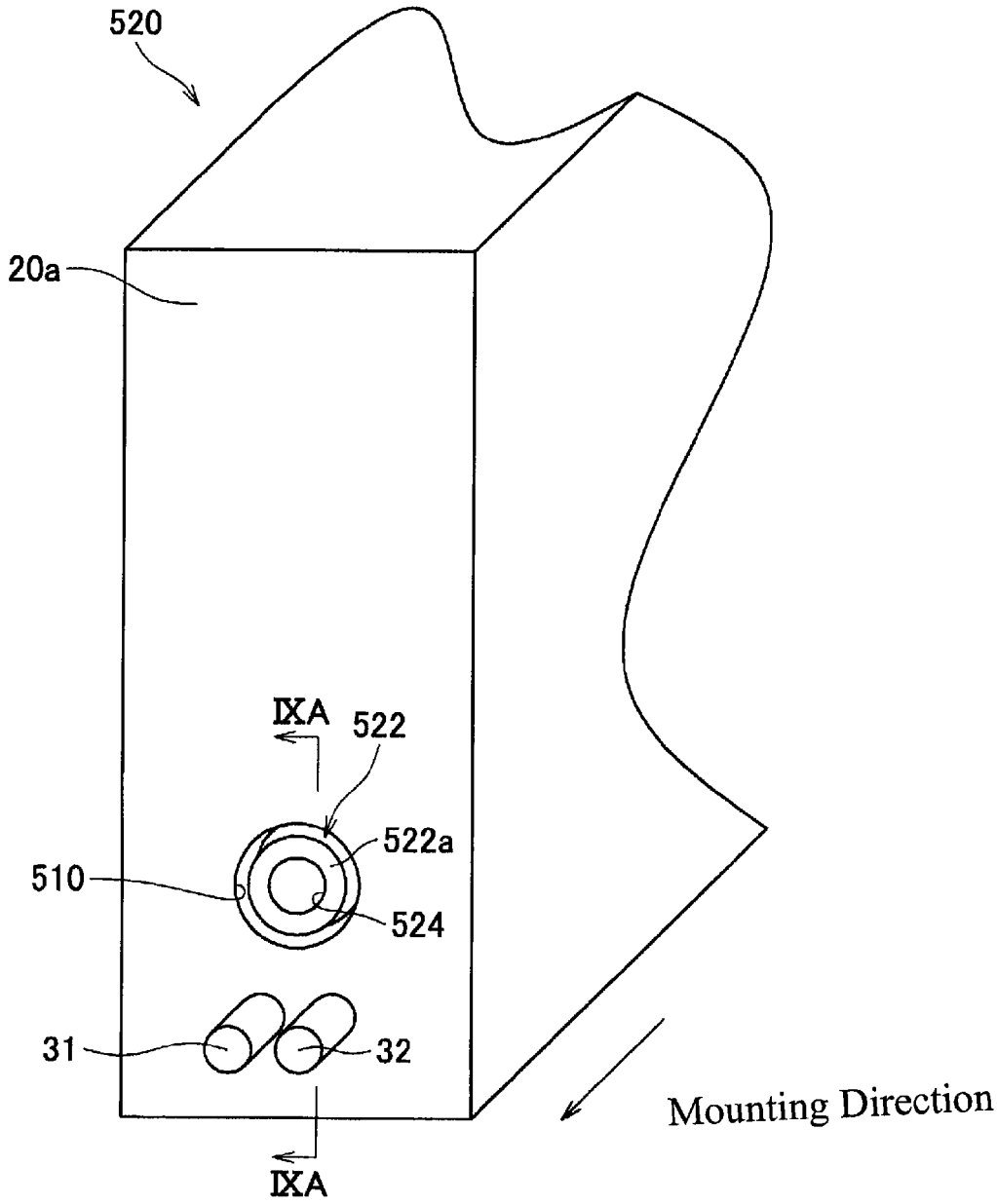
FIG. 8 is a partial, perspective view of an ink cartridge, according to still yet another embodiment of the present invention.
Figure 9A:
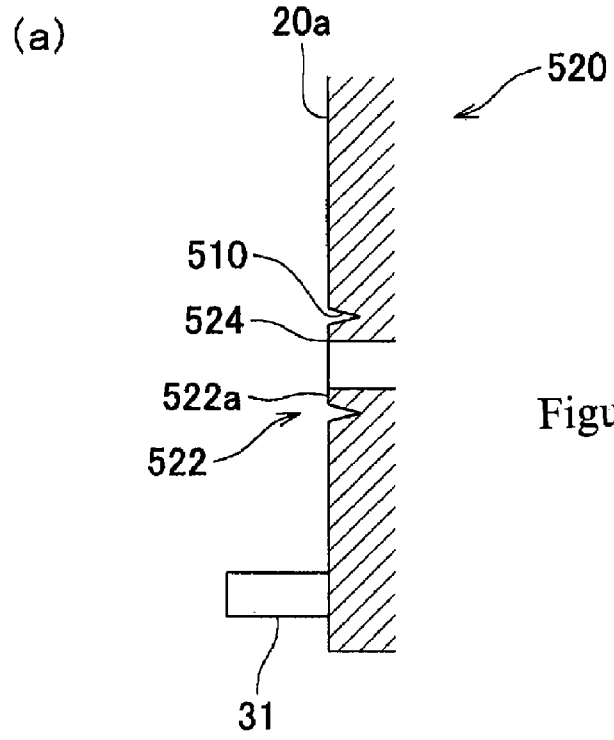
FIG. 9(*a*) is partial, cross-sectional view taken along IXA-IXA line in FIG. 8.
Figure 9B:
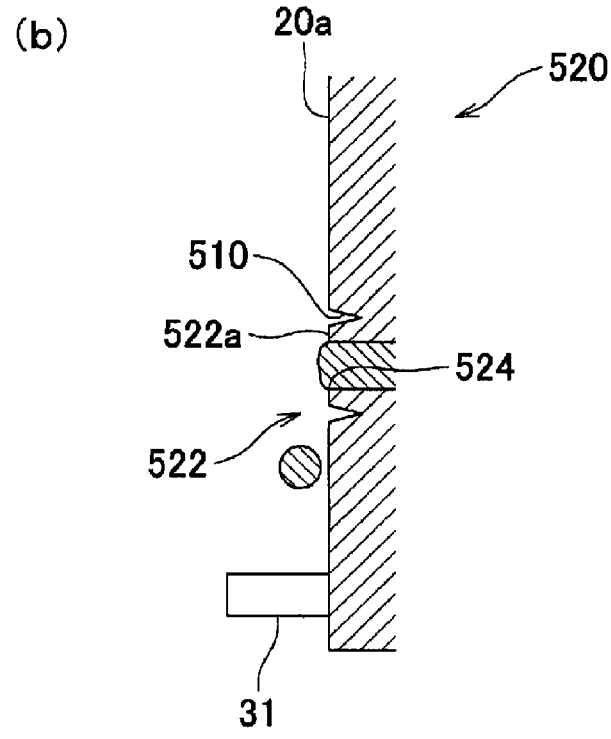

Referring to FIGS. 8, 9(*a*), and 9(*b*), an ink cartridge 520, according to still yet another embodiment of the present invention, may comprise an ink supply portion 522 at side wall 20*a*. An end surface 522*a* of ink supply portion 522 may be flush with side wall 20*a*, and an ink supply opening 524 may be formed in end surface 522*a*. An annular groove 522 may be formed in side wall 20*a* to encircle ink supply opening 524, and ink supply portion 522 may protrude with respect to an adjacent area of side wall 20*a*, such that the adjacent area corresponds to annular groove 522. A first line segment connecting a center of end surface 31*a* and a center of end surface 32*a* may be perpendicular to a second line segment connecting a center of the first line segment and a center of end surface 522*a*. The first line segment may be equal to a line segment connecting an axial center of first protrusion 31 and an axial center of second protrusion 32. The second line segment may equal to a line segment connecting the center of the first line segment and a center of ink supply opening 524. End surface 522*a* and ink supply opening 524 may have the same in shape as end surface 22*a* and ink supply opening 24, respectively. Referring to FIG. 9(*b*), an ink droplet, which has dripped from end surface 522*a*, does not contact side wall 20*a*, maintaining a spherical form and falls onto between first protrusion 31 and second protrusion 32. First protrusion 31 and second protrusion 32 may receive an ink droplet, which has dripped from ink supply opening 524/end surface 522*a*, and ink may be retained between first protrusion 31 and second protrusion 32 by a capillary force.

Figure 10:
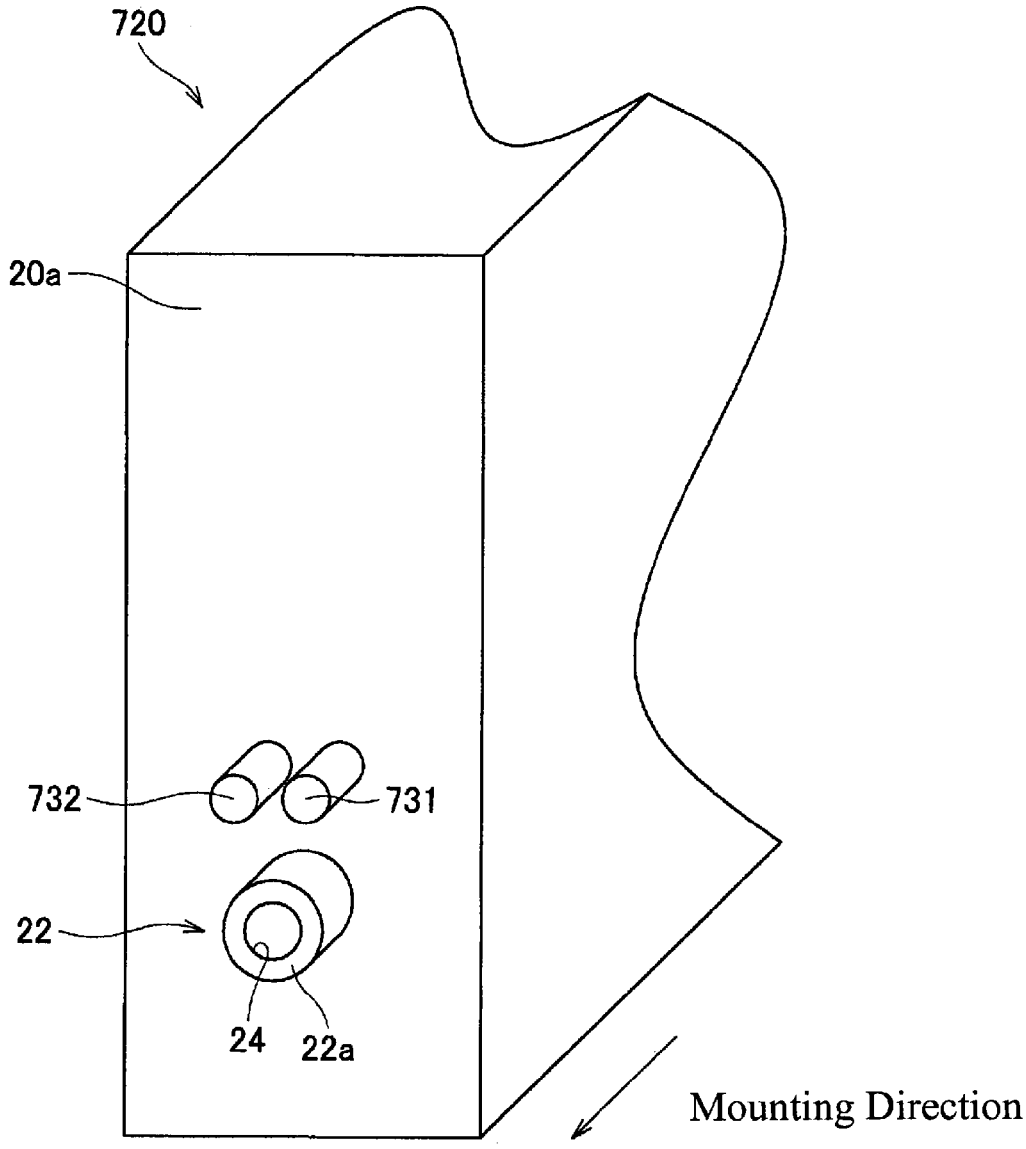
FIG. 10 is a partial, perspective view of an ink cartridge, according to a further embodiment of the present invention.

Referring to FIG. 10, an ink cartridge 720, according to a further embodiment of the present invention, may comprise a first protrusion 731 and a second protrusion 732 protruding from side wall 20*a*. By rotating first protrusion 31 and second protrusion 32 by 180 degrees around the center of ink supply portion 22, first protrusion 731 and second protrusion 732 are obtained. Specifically, first protrusion 731 and second protrusion 732 are the same in shape and size as first protrusion 31 and second protrusion 32, and first protrusion 731 and second protrusion 732 are positioned between the first end of side wall 20*a* and ink supply portion 22. When ink cartridge 720 is placed up side down after ink cartridge 720 is removed from mounting portion 16, first protrusion 731 and second protrusion 732 may receive an ink droplet, which has dripped from ink supply opening 24/end surface 22*a*, and ink may be retained between first protrusion 731 and second protrusion 732 by a capillary force.

Figure 11:
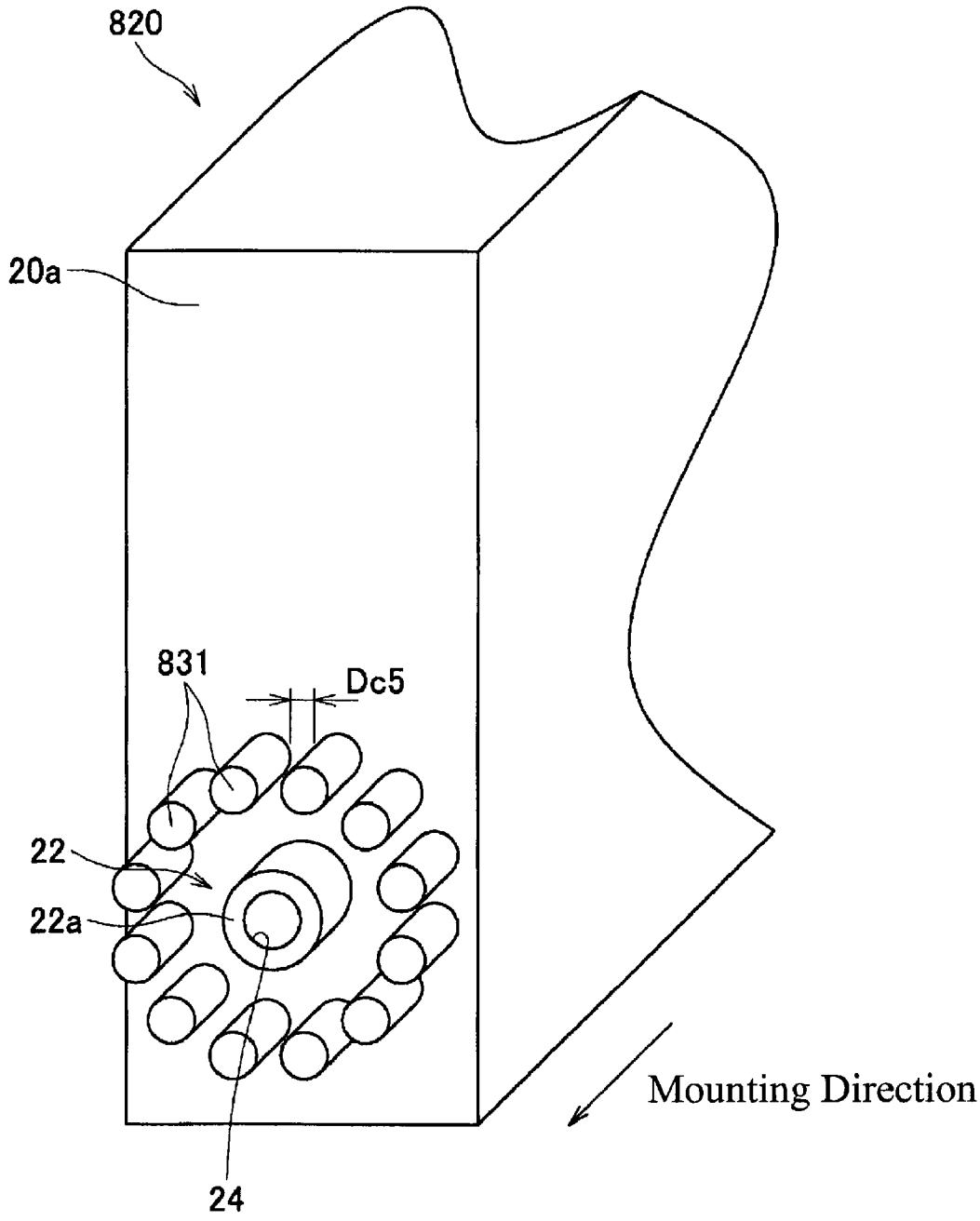
FIG. 11 is a partial, perspective view of an ink cartridge, according to yet a further embodiment of the present invention.

Referring to FIG. 11, an ink cartridge 820, according to yet a further embodiment of the present invention, includes twelve protrusions 831 protruding from side wall 20*a*. Twelve protrusions 831 may be the same as first protrusion 31 and second protrusion 32 in shape and size. Twelve protrusions 831 may be positioned on a circumference of a circle with the center of end surface 22*a* (the center of ink supply opening 24) being a center of the circle. Twelve protrusion 831 may be separated from each other at the same interval, and a separation distance Dc5 between immediate neighboring protrusions 831 may be about 4.5 mm. The separation distance Dc5 may be less than a maximum diameter of ink supply opening 24. Even when ink cartridge 820 is tilted after ink cartridge 820 is taken out of mounting portion 16, protrusions 831 may receive an ink droplet, which has dripped from ink supply opening 24/end surface 22*a*, and ink may be retained between protrusions 831 by a capillary force.

Figure 12:
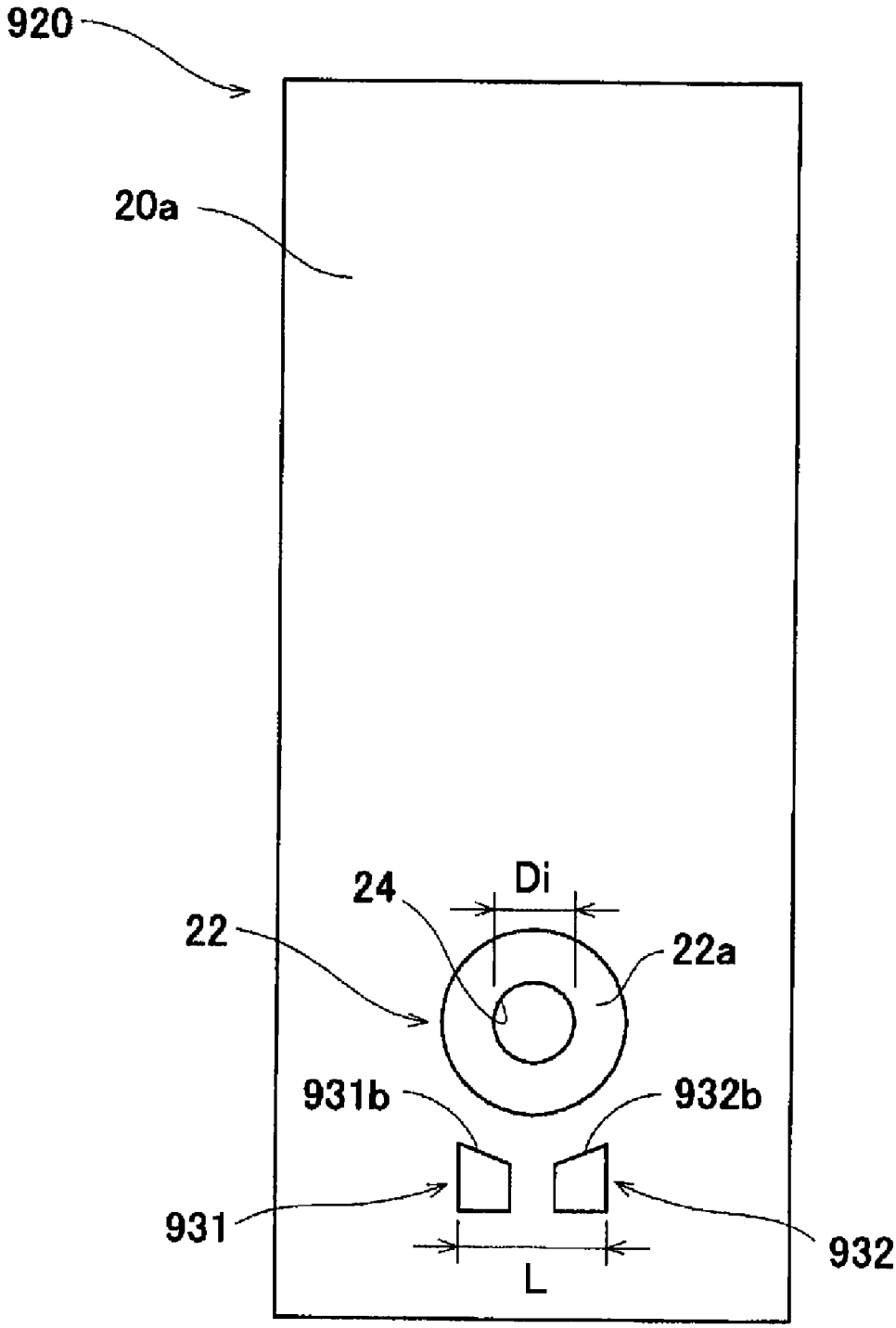
FIG. 12 is a side view of an ink cartridge, according to still a further embodiment of the present invention.

Referring to FIG. 12, an ink cartridge 920, according to still a further embodiment of the present invention, may comprise a first protrusion 931 and a second protrusion 932 protruding from side wall 20*a*, instead of first protrusion 31 and second protrusion 32. A first line segment connecting an axial center of first protrusion 931 and an axial center of second protrusion 932 may be perpendicular to a second line segment connecting a center of the first line segment and a center of end surface 22*a*. The second line segment may be equal to a line segment connecting the center of the first line segment and a center of ink supply opening 24. First protrusion 931 and second protrusion 932 may have side surfaces 931*b* and 932*b*, respectively. Each of side surfaces 931*b* and 932*b* may be inclined, such that each of side surfaces 931*b* and 932*b* comes close to the second end of side wall 20*a* while approaching a center of side wall 20*a* in the width direction. First protrusion 931 may have an end in the width direction, which is most distant from the center of side wall 20*a* in the width direction, and second protrusion 932 may have an end in the width direction, which is most distant from the center of the side wall 20*a* in the width direction. A distance L between the end of first protrusion 931 and the end of second protrusion 932 in the width direction may be greater than a maximum diameter Di of ink supply opening 24. A separation distance between first protrusion 931 and second protrusion 932 may be less than the maximum diameter Di. First protrusion 931 and second protrusion 932 may receive an ink droplet, which has dripped from ink supply opening 24/end surface 22*a*, and ink may be retained between first protrusion 931 and second protrusion 932 by a capillary force. Moreover, because each of side surfaces 931*b* and 932*b* is inclined, even when an ink droplet drips from a portion offset from the center of ink supply opening 24/end surface 22*a*, side surfaces 931*b* and/or 932*b* may receive the ink droplet.

A plurality of recesses may be formed in a mounting portion, which correspond to protrusions of ink cartridge respectively in the embodiments referring to FIGS. 5-12 as in the embodiment referring to FIGS. 1-4.

The present invention is not limited to the above-described embodiments. Various modifications may be applied. For example, the separation distance may be 2 mm. The separation distance being 2 mm may create a stronger capillary force. A direction that the protrusions protrude may not be parallel with the direction that an ink cartridge is mounted into mounting portion. In this case, the recesses may extend to correspond to the direction that protrusions protrude. The switch is not limited to a physical switch, and the switch may detect protrusions optically. For example, the switch may emit visible light or infra red light.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An ink cartridge, comprising:

an ink chamber configured to store an ink;

a wall comprising a first end and a second end opposite the first end;

an ink supply portion which is positioned at the wall, wherein the ink supply portion has an end portion and an ink supply opening formed in the end portion, and the ink supply portion is configured to supply the ink from an interior of the ink chamber to an exterior of the ink cartridge through the ink supply opening; and a plurality of protrusions protruding from the wall, wherein each of the plurality of protrusions has an end portion, and a first distance between the end portion of each of the plurality of protrusions and the wall is greater than a second distance between the end portion of the ink supply portion and the wall, wherein the plurality of protrusions comprise a first protrusion and a second protrusion positioned adjacent to the first protrusion, and the first protrusion is separated from the second protrusion by a separation distance, such that the first protrusion and the second protrusion are configured to retain an ink droplet positioned therebetween by a capillary force.

2. The ink cartridge of claim 1, wherein the ink supply portion is positioned adjacent to the second end of the wall and protrudes from the wall.

3. The ink cartridge of claim 1, wherein the ink supply portion comprises an ink supply path formed therethrough, and the ink supply path is in fluid communication with the interior of the ink chamber and the ink supply opening, wherein the ink supply path and each of the plurality of protrusions extend in a predetermined direction.

4. The ink cartridge of claim 1, wherein the end portion of the ink supply portion comprises an annular surface encircling the ink supply opening, and the relationship of $Dc \leqq 2((S0 \times \gamma \times 3)/(\rho \times \pi \times 4))^{1/3}$ is satisfied, where S0 is an outer circumferential length of the annular surface, $\gamma$ is a surface tension of ink, $\rho$ is a density of ink, and Dc is the separation distance.

5. The ink cartridge of claim 4, wherein the annular surface is perpendicular to the predetermined direction.

6. The ink cartridge of claim 5, wherein a first line segment connecting axial centers of the first protrusion and the second protrusion is perpendicular to a second line segment connecting a center of the first line segment and a center of ink supply opening.

7. The ink cartridge of claim 5, wherein the wall further comprises a third end and a fourth end opposite the third end, and the wall has a height between the first end of the wall and the second end of the wall, wherein the wall has a width between the third end of the wall and the fourth end of the wall, and a direction of the height of the wall is perpendicular to a direction of the width of the wall, wherein the first protrusion and the second protrusion are aligned in the width direction, and each of the first protrusion and the second protrusion comprises a side surface, wherein each of the side surfaces is inclined such that each of side surfaces comes close to the second end of the wall while approaching a center of the wall in the width direction, and each of the first protrusion and the second protrusion has an end in the width direction which is most distant from the center of the wall in the width direction, wherein a distance between the both ends of the first protrusion and the second protrusion in the width direction is greater than a diameter of ink supply opening.

8. The ink cartridge of claim 1, wherein the separation distance between any two adjacent protrusions of the plurality of protrusions is greater than 0 mm and less than 5 mm.

9. The ink cartridge of claim 8, wherein the plurality of the protrusions are positioned on a circumference of a circle with a center of the ink supply portion being a center of the circle.

10. The ink cartridge of claim 1, wherein the ink supply portion comprises a valve configured to selectively open and close the ink supply opening.

11. An inkjet printer, comprising:

a mounting portion; and the ink cartridge as in claim 1 mounted to the mounting portion, wherein the mounting portion comprises recesses configured to receive the first protrusion and the second protrusion, respectively, and the mounting portion comprises a detector configured to detect a presence of at least one of the first protrusion and the second protrusion.

12. An ink cartridge, comprising:

an ink chamber configured to store an ink;

a wall comprising a first end and a second end opposite the first end;

an ink supply portion which is positioned at the wall, wherein the ink supply portion has an end portion and an ink supply opening formed in the end portion, and the ink supply portion is configured to supply the ink from an interior of the ink chamber to an exterior of the ink cartridge through the ink supply opening;

a first protrusion protruding from the wall; and a second protrusion protruding from the wall, wherein each of the first protrusion and the second protrusion has an end portion, and a first distance between the end portion of each of the first protrusion and the second protrusion and the wall is greater than a second distance between the end portion of the ink supply portion and the wall, wherein the end portion of the ink supply portion comprises an annular surface encircling the ink supply opening, and the relationship of $Dc \leqq 2((S0 \times \gamma \times 3)/(\rho \times \pi \times 4))^{1/3}$ is satisfied, where S0 is an outer circumferential length of the annular surface, $\gamma$ is a surface tension of an ink stored in the ink chamber, $\rho$ is a density of the ink, and Dc is a particular separation distance between the first protrusion and the second protrusion.

13. The ink cartridge of claim 12, wherein the ink supply portion comprises an ink supply path formed therethrough, and the ink supply path is in fluid communication with the interior of the ink chamber and the ink supply opening, wherein the ink supply path and each of the first protrusion and the second protrusion extend in a predetermined direction.

14. The ink cartridge of claim 12, wherein the ink supply portion comprises a valve configured to selectively open and close the ink supply opening.

15. The ink cartridge of claim 12, wherein the ink supply portion is positioned adjacent to the second end of the wall and protrudes from the wall, and the first protrusion and the second protrusion are positioned between the ink supply portion and the second end of the wall.

16. The ink cartridge of claim 15, wherein a first line segment connecting an axial center of the first protrusion and an axial center of the second protrusion is perpendicular to a second line segment connecting a center of the first line segment and a center of ink supply opening.

17. The ink cartridge of claim 16, wherein the wall further comprises a third end and a fourth end opposite the third end, and the wall has a height between the first end of the wall and the second end of the wall, wherein the wall has a width between the third end of the wall and the fourth end of the wall, and a direction of the height of the wall is perpendicular to a direction of the width of the wall, wherein the first protrusion and the second protrusion are aligned in the width direction, and the first protrusion comprises a first side surface, wherein the second protrusion comprises a second side surface, and the first side surface is inclined such that the first side surface comes close to the second end of the wall while approaching a center of the wall in the width direction, wherein the second side surface is inclined such that the second side surface comes close to the second end of the wall while approaching a center of the wall in the width direction, and the first protrusion has a first end in the width direction, which is most distant from the center of the wall in the width direction, wherein the second protrusion has a second end in the width direction, which is most distant from the center of the wall in the width direction, and a distance between the first end and the second end in the width direction is greater than the diameter of ink supply opening.

18. The ink cartridge of claim 16, further comprising a third protrusion, wherein a further separation distance between the first protrusion and the third protrusion is greater than 0 mm and less than the diameter of the ink supply opening, and a still further separation distance between the second protrusion and the third protrusion is greater than 0 mm and less than the diameter of the ink supply opening.

19. The ink cartridge of claim 18, wherein a third line segment connecting the center of the first line segment and an axial center of third protrusion is perpendicular to the first line segment.

20. An ink cartridge, comprising:

a wall;

an ink supply portion positioned at the wall, wherein the ink supply portion has an ink supply opening formed therein; and a plurality of protrusions comprising a first protrusion and a second protrusion, wherein each of the first protrusion and the second protrusion extend from the wall, and a distance between the first protrusion and the second protrusion is greater than 0 mm and less than a diameter of the ink supply opening, such that the first protrusion and the second protrusion are configured to retain an ink droplet positioned therebetween by a capillary force.

21. The ink cartridge of claim 20, wherein the ink supply portion extends from the wall, and each of the first protrusion and the second protrusion extends further from the wall than the ink supply portion extends from the wall.

22. An ink cartridge, comprising:

a wall;

an ink supply portion positioned at the wall, wherein the ink supply portion has an ink supply opening formed therein; and a plurality of protrusions comprising a first protrusion and a second protrusion, wherein each of the first protrusion and the second protrusion extend from the wall, and the ink supply portion comprises an annular surface encircling the ink supply opening, and the relationship of $Dc \leqq 2((S0 \times \gamma \times 3)/(\rho \times \pi \times 4))^{1/3}$ is satisfied, where S0 is an outer circumferential length of the annular surface, $\gamma$ is a surface tension of an ink, $\rho$ is a density of the ink, and Dc is a distance between the first protrusion and the second protrusion.

23. The ink cartridge of claim 22, wherein the ink supply portion extends from the wall, and each of the first protrusion and the second protrusion extends further from the wall than the ink supply portion extends from the wall.

* * * * *